United States Patent [19]

Conti

[11] 4,170,673

[45] Oct. 9, 1979

[54] METHOD FOR PULLING CABLE

[76] Inventor: Allen C. Conti, 5294 E. 117th St., Garfield Heights, Ohio 44125

[21] Appl. No.: 896,105

[22] Filed: Apr. 13, 1978

Related U.S. Application Data

[63] Continuation-in-part of Ser. No. 839,077, Oct. 3, 1977, Pat. No. 4,111,820.

[51] Int. Cl.[2] ..... B05D 1/00; B05D 3/00

[52] U.S. Cl. ..... 427/401; 427/434 D; 428/375

[58] Field of Search ..... 427/401, 434 D, 434 E, 427/384, 398 R; 252/49.3, 49.5, 52 A, 52 R; 428/375

[56] References Cited

U.S. PATENT DOCUMENTS

| | | | |
|---|---|---|---|
| 3,000,826 | 9/1961 | Gililland | 252/49.3 |
| 3,925,216 | 12/1975 | Moorhouse | 252/49.3 |
| 3,983,042 | 9/1976 | Jain et al. | 252/49.5 |
| 4,028,473 | 6/1977 | Conti | 427/434 E |
| 4,045,362 | 8/1977 | Kuan et al. | 252/49.3 |

*Primary Examiner*—Ronald H. Smith
*Assistant Examiner*—Sadie L. Childs
*Attorney, Agent, or Firm*—Thomas H. Murray; Clifford A. Poff

[57] ABSTRACT

A coating consisting essentially of 0.5% to 50%, preferably 2% to 20%, by volume, polyethylene oxide and about 6% to 30% a dispersion agent selected from the group consisting of propylene glycol, glycerol, ethylene glycol, polypropylene glycol, diethylene glycol, thiethylene glycol and hexylene glycol, with the ratio of polyethylene oxide-to-dispersion agent, by volume, being no greater than 2:1 and preferably 1:3. The remainder being essentially water. The coating is used as a lubricant to facilitate pulling plastic-sheathed cable through a conduit and to facilitate the passage of mixed concrete through a conduit.

3 Claims, No Drawings

METHOD FOR PULLING CABLE

CROSS-REFERENCE TO RELATED APPLICATION

This application is a continuation-in-part of application Ser. No. 839,077, filed Oct. 3, 1977 now U.S. Pat. No. 4,111,820.

BACKGROUND OF THE INVENTION

This invention relates to a coating composition to protect and lubricate, if desired, the surface of an article without adversely affecting or otherwise degrading the physical properties of the article onto which the coating is applied. More particularly, the present invention relates to using such a coating to form a lubricant and/or wetting agent for the surface of a cable to be pulled through a conduit, duct or raceway and to form a lubricant for the passage of mixed concrete through a conduit or duct.

The coating of the present invention is used to form a lubricant to facilitate movement of a cable or a mass of mixed concrete through a die, conduit or duct. During the pulling of cable, the ever-present problem of friction occurs between the outside surface of the cable being pulled and the inside surface of the passageway. From an economic standpoint, it is desirable to use the longest possible length of cable during a single pull through the conduit or duct. However, as the length of cable involved in a single pull increases, there is a corresponding increase to the necessary pulling force imposed on the cable. If an excessive pulling force is developed, the cable elongates beyond an allowable value causing fractures or breaks to occur. After a cable is drawn into a conduit or raceway, it is frequently necessary to move the cable in a reverse direction to facilitate dressing operations to the surface of the cable sheathing. Back and Forth adjustments to the position of cable within a conduit is required when the preselected lengths of cable have their ends pre-equipped with a system of connectors.

In the past, a thixotropic paraffin-based gel, or petroleum-based lubricant was applied by hand onto the surface of the cable preparatory to the pulling operation. An applicator system such as is disclosed in U.S. Pat. No. 4,028,473, eliminated much of the labor and mess usually associated with manual application of the lubricant onto the cable. However, a heavy residue of lubricant remains on the surface of the cable whereby the necessary splicing operations were impeded because of the residue particularly in an underground environment.

Instead of a thixotropic paraffin-based gel or petroleum-based lubricant, there is disclosed in U.S. Pat. No. 3,925,216, a lubricant comprised of polyethylene oxide in an alcohol-water solution. Such a lubricant will eliminate much of the clean-up operations because it provides a desirable property of rapid evaporation. However, this lubricant has inferior friction-reducing properties as compared to a thixotropic gel, particularly in regard to the necessary cable dressing operations and back and forth adjustments of the cable when using selected lengths with pre-prepared connectors. A lubricant of polyethylene oxide in an alcohol-water solution will rapidly evaporate and is highly water-soluble whereby little lubricant, if any, remains after the pulling operation is completed. However, this lubricant composition can be useless or ineffective when the ductwork contains or is filled with water as frequently occurs when the ductwork is underground.

Detrimental effects due to friction occur at the inside surface of a passageway as a mass of mixed concrete is forced to move along the passageway. The present-day practice of transporting mixed concrete by a pump from a vehicle to the actual job site offers many advantages. The mixed concrete is moved in a conduit which is made of steel, aluminum or plastic materials to provide strength and abrasion resistance. The conduit usually includes articulated joints or the like so that the conduit can be placed to extend along the desired course. Because of the pressures involved, the power needed to move mixed concrete over a given height or distance is necessarily large, particularly because of the weight of the concrete (e.g., 4000 lbs per cubic yard). However, by using an effective lubricant along the inside wall of the conduit, the concrete mixture will pass more effeciently along the conduit and through articulated joints. The lubricant not only minimizes the loss of power due to friction but also minimizes a liquid-to-solid phase segregation to the concrete due to its movement along the conduit. In this regard, a homogenous concrete mixture is known to undergo segregation into aggregate phase and a cement-paste phase which sometimes undergoes further separation into a water and thick cement-paste phase.

SUMMARY OF THE INVENTION

It is an object of the present invention to employ a novel coating composition consisting essentially of an aqueous solution of a dispersion agent and polyethylene oxide for cable-pulling operations and for transferring a mass of mixed concrete.

It is a further object of the present invention to provide a gel-like, semi-liquid coating and/or lubricant having a novel composition which is non-degrading to a mass of mixed concrete, a metal or plastic conduit and sheathing for cable made of polyethylene or polyurethane material; will not readily evaporate at warm outdoor temperatures; will not freeze at outdoor sub-freezing temperatures; and viscoelastic, yet removable, with a water flush to enable handling of a coated element.

The coating and/or lubricant solution according to the present invention essentially consists of about 0.5% to 50% by volume polyethylene oxide and about 6% to 30% by volume a dispersion agent selected from the group consisting of propylene glycol, glycerol, ethylene glycol, polypropylene glycol, diethylene glycol, triethylene glycol and hexylene glycol, the ratio of the volume of polyethylene oxide to the volume of a dispersion agent being no greater than 2:1 and the remainder being water. Polyethylene oxide, by volume, is preferably within the range of 2% to 20%. In still other terms, the coating of the present invention essentially consists of at least about 2 parts by volume a dispersion agent selected from the group consisting of propylene glycol, glycerol, ethylene glycol, polypropylene glycol, diethylene glycol, triethylene glycol and hexylene glycol, and 1 part by volume polyethylene oxide and at least about 4 parts by volume water. However, 3 parts by volume of the dispersion agent, propylene glycol, are preferred.

The present invention provides a method for pulling cable having a protective sheathing of polyethylene or polyurethane through a conduit, duct or the like wherein the method includes the steps of applying to the outer surface of the sheathing a non-degrading lubricant consisting essentially of the coating as defined hereinabove and then drawing the cable in the conduit while the coating remains on the outer surface of the sheathing.

The present invention further provides a method for conducting a flowable mass such as mixed concrete and the like within a conduit wherein the method includes the steps of feeding the flowable mass into the conduit to flow therealong essentially in the form of a stream, and feeding an effective amount of lubricant consisting essentially of the coating as defined hereinabove into the conduit to form a film of lubricant between the interior wall of the conduit and the surface of the flowable mass moving therealong.

DETAILED DESCRIPTION

The preferred coating composition to carry out the method of the present invention consists essentially of 3 parts by volume the dispersion agent, propylene glycol, and 1 part by volume polyethylene oxide with an average molecular weight of 4,000,000, and between 9 and 40 parts water but preferably 25 parts by volume water. By volume, the dispersion agent forms between 23% and 7% but 10% is preferred in the coating and polyethylene oxide forms between 9% and 2% but about 4% is preferred in the coating. The propylene glycol and polyethylene oxide are admixed together to form a slurry. The water constituent is either added to the slurry or the slurry is added to water. In either event, mixing is achieved after about twenty-five seconds of rapidly stirring the mixture at about 1150 revolutions per minute. The composition is allowed to set for twenty-four hours to permit the release of entrapped air. The resulting lubricant composition is extremely viscoelastic. The preferred dispersion agent of propylene glycol in the coating has a good lubricating property. However, it has been found according to the present invention that a dispersion agent constituent of the coating may be selected from the group consisting of propylene glycol, glycerol, ethylene glycol, polypropylene glycol, diethylene glycol, triethylene glycol and hexylene glycol. For this group of dispersion agents, propylene glycol is especially useful as the dispersion agent because it is miscible with water, a non-solvent of polyethylene, and a freezing point lower than water, e.g., −60° F. in a 60% by volume solution, friction-reducing agent, viscosity stabilizer, biodegradable, environmentally safe, non-toxic, non-destructive to plastics, rubber and metals. A suspension of polyethylene oxide in propylene glycol and the later-addition of water increases synergistically the viscoelasticity and lubricity of the coating.

In the coating composition of the present invention, the water component reduces the ultimate thickness of the mixture. When compounding, the water component may be at any temperature except boiling. It is preferred to use ordinary tap water at room temperature. The suspension medium, i.e., propylene glycol, acts as a dispersion agent whereby the ratio of polyethylene oxide to propylene glycol by volumes can go from a minuscule amount of polyethylene oxide to an upper limit of 2 parts polyethylene oxide to 1 part propylene glycol. At this ratio of 2:1, a dispersion will still be effective. However, if the ratio of 2:1 is exceeded and water is added, the slurry forms into globules that resist further mixing without a decrease to the viscoelasticity of the mixture. Special equipment and mixing techniques are necessary to dissolve polyethylene oxide without a dispersion agent in water. As the polyethylene oxide hydrates, special mixing procedures are necessary to avoid shear which is a rupture of the chain link formed with water.

Polyethylene oxide is commercially available under the trademark POLOX from Union Carbide Corporation with the preferred average molecular weight being sold under the designation POLYOX WSR-301. Ranges of 0.5% to 50% polyethylene oxide (POLYOX) are tolerable in the coating composition of the present invention. Within this range, the viscoelasticity of the lubricant increases to a non-pourable substance at about 50% by volume polyethylene oxide. It has been found that the lubricity of the coating composition is approximately the same for all of the various mixtures but the ideal ranges of the components for a particular application have been expressed herein. It has been found that the lubricity of the coating composition increases in a water environment through which an object coated with the lubricant is passed.

In the field of metalworking, the coating of the present invention is an effective annealing and normalizing agent, a lubricant and coolant for workpieces during roughening and finishing operations, such as rolling and strip-finishing operations and as a rust and scale control agent. When the coating is used for metalworking of aluminum, copper and ferrous metals, the coating is comprised of 3 parts (30% to 23%) by volume a dispersion agent, 1 part (10% to 9%) by volume polyethylene oxide and 6 to 9 parts water by volume.

To control rust and scale formation, the coating was tested by heating a 24-inch rod of 1040 carbon steel until red. One-half of the length of rod was dipped in a bath of coating consisting of 3 parts by volume propylene glycol, 1 part by volume polyethylene oxide and 9 parts by volume water. The coating tightly adhered to the rod surface. The rod was then placed in the open atmosphere and allowed to cool. The coated end cooled slower and required between 30 to 60 minutes longer to cool to room temperature as compared with the uncoated part of the rod. During the next 6 to 8 hours, the coated end underwent a slow oxidation, acquiring a rusty appearance. However, between 5 to 7 days later, the uncoated end oxidized to a heavy coating of rust whereas the appearance of the coated end remained essentially constant. The rod was then flushed with water. The coating and rusty appearance were flushed away from the coated end while the uncoated end retained the rust formation after flushing with water. The same test and results occurred with a coating comprising 3 parts by volume propylene glycol, 1 part by volume polyethylene oxide and 6 parts by volume water. In other tests, the rod was not heated but the same results were obtained with both coating compositions.

The novel coating composition of the present invention has been found particularly useful for pulling underground power, electric or telephone cables of the type which include metal conductors or glass fiber. When such cable is protected by polyethylene or polyurethane sheathing, many lubricant coatings are effective. However, it is very important that a lubricant compound does not adversely affect the sheathing. Degrading of the sheathing material as by, for example, increasing the stress cracking potential will allow water and elements to adversely affect the transmission medium causing disruptions of service and damage to the cable. The unique group of dispersion agents used in the lubricant composition of the present invention as well as the component of polyethylene oxide are non-degrading to such sheathing materials. However, it has been found that the use of alcohol as disclosed in U.S. Pat. No. 3,925,216 as a component in a lubricant can adversely affect a sheathing of polyethylene and polyurethane materials.

To carry out the method of the present invention a flowable mass of mixed concrete is fed from a container by a suitable pump into a conduit usually made from plastic, steel or aluminum. The discharge end of the conduit extends to the site where the concrete is to be poured. The site is usually a diverse area. Flexible conduit or articulated joints permit relocation of the discharge end of the conduit. At a convenient point, preferably adjacent the end of the conduit receiving the mixed concrete, a lubrication reservoir between two concentric sleeves such as shown in U.S. Pat. No. 4,028,473 is coupled in the conduit. Holes in the inner sleeve discharge the pressurized lubricant coating at spaced points about the periphery of the conduit whereby the mass of moving concrete carries the lubricant downstream. The lubricant coating remains at the interface surfaces between the conduit and the concrete. The coating composition is non-degrading to the mixed concrete. An effective amount of lubricant is fed continuously or intermittently into the conduit. An effective amount depends upon the size and material of the conduit as well as the slump of the mixed concrete. However, the use of an effective amount of lubricant does not change the slump of the mixed concrete. Typically, 1 gallon per 7 to 8 cubic yards of concrete passed in a 4" diameter steel conduit is an effective amount of lubricant.

Although the invention has been shown in connection with certain specific embodiments, it will be readily apparent to those skilled in the art that various changes in composition can be made without departing from the spirit and scope of the invention.

I claim as my invention:

1. A method for pulling cable having a protective sheathing of polyethylene or polyurethane through a conduit, duct or the like, said method including the steps of:

coating the outer surface of said protective sheathing with a non-degrading lubricant solution consisting essentially of about 0.5% to 50% by volume polyethylene oxide and about 6% to 30% by volume a dispersion agent selected from the group consisting of propylene glycol, glycerol, ethylene glycol, polypropylene glycol, diethylene glycol, triethylene glycol, and hexylene glycol, the ratio of the volume of polyethylene oxide to the volume of said dispersion agent being about 1:3, and the remainder being water; and drawing said cable along a conduit while the lubricant remains on the outer surface of said protective sheathing.

2. The method according to claim 1 wherein said polyethylene oxide is within the range of 2% to 20% by volume.

3. The method according to claim 2 wherein said dispersion agent is propylene glycol and within the range of 23% to 7% by volume.

* * * * *